US010121588B2

(12) United States Patent
Kitagawa et al.

(10) Patent No.: US 10,121,588 B2
(45) **Date of Patent: *Nov. 6, 2018**

(54) METHOD AND APPARATUS FOR PREPARING RARE EARTH SINTERED MAGNET

(71) Applicant: Shin-Etsu Chemical Co., Ltd., Tokyo (JP)

(72) Inventors: Mitsuo Kitagawa, Echizen (JP); Kazuaki Sakaki, Echizen (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 890 days.

This patent is subject to a terminal disclaimer.

(21) Appl. No.: 14/578,960

(22) Filed: Dec. 22, 2014

(65) Prior Publication Data

US 2015/0179337 A1 Jun. 25, 2015

(30) Foreign Application Priority Data

Dec. 24, 2013 (JP) ..... 2013-265244

(51) Int. Cl.
*B22F 3/00* (2006.01)
*H01F 41/02* (2006.01)
(Continued)

(52) U.S. Cl.
CPC ..... *H01F 41/0266* (2013.01); *B22F 3/004* (2013.01); *B22F 3/03* (2013.01);
(Continued)

(58) Field of Classification Search
CPC ..... B22F 3/00
See application file for complete search history.

(56) References Cited

U.S. PATENT DOCUMENTS 7,147,820 B2 * 12/2006 Hinzpeter ..... B22F 3/004 419/38
2002/0051726 A1 5/2002 Nakamura et al.
2002/0060230 A1 * 5/2002 Zysset ..... B07B 1/42 222/189.05

FOREIGN PATENT DOCUMENTS

CN 1618551 A 5/2005
JP 2001-058294 A 3/2001
JP 2005-205481 A 8/2005

OTHER PUBLICATIONS

Office Action dated Aug. 27, 2018, issued in counterpart Taiwanese Application No. 103144997, with English translation. (14 pages).

* cited by examiner

*Primary Examiner* — Christopher S Kessler
(74) *Attorney, Agent, or Firm* — Westerman, Hattori, Daniels & Adrian, LLP

(57) ABSTRACT

A mold comprising a die, an upper punch, and a lower punch, the pressure surface of one or both of the upper and lower punches being shaped non-planar, a cavity being defined between the die and the lower punch, is combined with a feeder including a shooter provided with a main sieve at its lower end port, the main sieve having a sifting surface of substantially the same non-planar shape as the pressure surface. A rare earth sintered magnet is prepared by feeding an alloy powder into the cavity through the shooter and sieve while applying weak vibration to the shooter, applying a uniaxial pressure to the alloy powder fill in the cavity under a magnetic field to form a precursor, and heat treating the precursor.

11 Claims, 3 Drawing Sheets

(51) Int. Cl.

| | |
|---|---|
| ***B22F 3/03*** | (2006.01) |
| ***B30B 11/00*** | (2006.01) |
| ***B30B 11/02*** | (2006.01) |
| ***B30B 15/30*** | (2006.01) |
| *H01F 1/053* | (2006.01) |

(52) U.S. Cl.

CPC ..... *B30B 11/008* (2013.01); *B30B 11/027* (2013.01); *B30B 15/302* (2013.01); *H01F 1/053* (2013.01)

METHOD AND APPARATUS FOR PREPARING RARE EARTH SINTERED MAGNET

CROSS-REFERENCE TO RELATED APPLICATION

This non-provisional application claims priority under 35 U.S.C. § 119(a) on Patent Application No. 2013-265244 filed in Japan on Dec. 24, 2013, the entire contents of which are hereby incorporated by reference.

TECHNICAL FIELD

This invention relates to a method and apparatus for preparing a rare earth sintered magnet, and more particularly, to a method for preparing a rare earth sintered magnet of unique shape, typically C or D shape by feeding an alloy powder to a mold, filling the mold cavity with the powder, and molding the powder under a magnetic field.

BACKGROUND ART

Nowadays, by virtue of their superior magnetic properties, rare earth sintered magnets, typically neodymium-based magnets are widely used in motors, sensors and other devices to be mounted in hard disks, air conditioners, hybrid vehicles, and the like.

In general, rare earth sintered magnets are prepared by powder metallurgy as follows. First, raw materials are mixed in accord with a predetermined composition. Using a high-frequency induction furnace, the mixture is melted and cast into an alloy. The alloy is coarsely crushed by a grinding machine such as a jaw crusher, Brown mill or pin mill or hydrogen decrepitation (or hydrogen embrittlement treatment) and then finely milled by a jet mill or the like, obtaining a fine powder having an average particle size of 1 to 10 μm. The fine powder is molded into a compact of desired shape while applying a magnetic field for imparting magnetic anisotropy. The compact is sintered and heat treated to form a sintered magnet.

In the preparation of rare earth sintered magnets by powder metallurgy, the step of molding under a magnetic field typically uses a mold consisting of a die, an upper punch and a lower punch. Molding is carried out by filling the mold cavity defined between the die and the lower punch with the fine powder, and forcing the upper punch to apply a uniaxial pressure to the powder. The mold cavity is fully filled with the fine powder so that the upper surface of the powder fill may be flush with the top of the die.

In the molding step, it is practiced for the purpose of improving the production yield to compression mold the powder fill into a compact shape which is close to the shape of the final magnet product. In an example where the final magnet product is of C shape, the powder is molded into a compact of an approximate C shape. To this end, the pressure surfaces of the upper and lower punches are shaped non-planar. In this case, if the mold cavity is fully filled with fine powder so that the upper surface of powder may be flush with the top of the die, the amount of powder fill in the cavity per height of a magnet product to be molded is non-uniform among horizontally spaced apart positions. When the powder fill is compression molded in this state, the molded compact has a varying density owing to the difference of fill amount. A problem arises when this compact is sintered. Namely, due to a difference in shrinkage between different sites in the compact, the sintered body can be warped or deformed and at the worst, cracked or fissured. These problems invite a drop of production yield.

As means for preventing the sintered body from cracking or fissure, Patent Document 1 discloses a method of chamfering the working surface of a punch, and adjusting the chamfer width and/or refining the roughness of the working surface. Although the method is effective for preventing the sintered body from cracking or fissure, the method is limited to the preparation of magnets of a special shape that permits a mold to be chamfered. Since the problem of compact density pointed out above remains unsolved, the method is substantially ineffective for suppressing the sintered body from warp or deformation.

Patent Document 2 discloses a powder feeder box including a box housing and a guide for leveling the powder flat wherein the powder is smoothed out conformal to the upper shape of the compact to be molded. This method eliminates the difference of fill amount and hence, the variation of compact density. However, the assembly of the feeder box is cumbersome, indicating inefficiency. A number of guides are necessary to meet the shape of every upper punch. The apparatus is thus redundant.

CITATION LIST

Patent Document 1: JP-A 2001-058294
Patent Document 2: JP-A 2005-205481

DISCLOSURE OF INVENTION

An object of the invention is to provide a method and an apparatus for preparing a rare earth sintered magnet of unique shape, typically C or D shape, which method is effective for preventing the sintered body from warp or deformation and even from cracking or fissure while improving the production yield.

The invention is directed to a method for preparing a rare earth sintered magnet by uniaxial compression of a rare earth magnet-forming alloy powder using a mold comprising a die, an upper punch, and a lower punch, one or both of the upper and lower punches having a pressure surface which is shaped non-planar. A cavity is defined between the die and the lower punch. A feeder includes a shooter for feeding the alloy powder into the cavity. The shooter is provided at its lower end port with a main sieve, the main sieve having a sifting surface of substantially the same non-planar shape as the pressure surface of the upper or lower punch. When the alloy powder is fed into the cavity through the shooter, weak vibration is applied to the shooter to assist the alloy powder to pass through the main sieve and fall into the cavity. Then the cavity is filled with the alloy powder such that the amount of powder fill per height of a magnet product to be molded is kept uniform independent of positions. As a result, the compressed compact has a uniform density in its entirety. The method is effective for preventing the sintered body from warp or deformation and even from cracking or fissure. As long as only the sieve having a sifting surface of substantially the same non-planar shape as the pressure surface of the upper or lower punch is furnished, the method can accommodate a variety of product shapes and ensures efficient preparation of sintered magnets.

The invention provides a magnet preparing method and an apparatus as defined below.

[1] A method for preparing a rare earth sintered magnet from a corresponding alloy powder using a mold and a feeder, said mold comprising a die, an upper punch having a pressure surface, and a lower punch having a pressure surface, the pressure surface of one or both of the upper and lower punches being shaped non-planar, a cavity being defined between the die and the lower punch, the feeder including a shooter having a lower end port for passage of the alloy powder, the port being aligned with the cavity, said method comprising the steps of feeding the alloy powder from the feeder into the cavity through the shooter until the cavity is filled with the alloy powder, compressing the alloy powder fill in the cavity under a magnetic field between the upper and lower punches for uniaxial pressure molding to form a precursor, and heat treating the precursor, characterized in that the shooter is provided with a main sieve at its lower end port such that the main sieve is disposed closely above the cavity, the main sieve having a sifting surface of substantially the same non-planar shape as the pressure surface of the upper or lower punch, during the step of feeding the alloy powder into the cavity through the shooter, weak vibration is applied to the shooter to assist the alloy powder to pass through the main sieve and fall into the cavity.

[2] The method of [1] wherein the main sieve has an opening of 10 to 22 mesh.

[3] The method of [1] or [2] wherein at least a portion of the pressure surface of one or both of the upper and lower punches is a curved surface of arch or inverse arch shape.

[4] The method of [1] or [2] wherein the pressure surface of the upper punch is a curved surface of arcuate arch shape, and the pressure surface of the lower punch consists of a curved surface segment of arcuate arch shape and two flanks extending from the opposite edges of the curved surface segment and inclined toward the convex side of the arch.

[5] The method of any one of [1] to [4] wherein the shooter is provided with at least one auxiliary sieve in its interior above the main sieve.

[6] The method of [5] wherein the auxiliary sieve has a sifting surface of substantially the same non-planar shape as the sifting surface of the main sieve.

[7] The method of [5] or [6] wherein the main and auxiliary sieves are arranged such that their opening becomes coarser toward the top.

[8] The method of any one of [1] to [7] wherein the feeder includes a powder distributor disposed above the main sieve for distributing the alloy powder over the main sieve so that the alloy powder may fall throughout the main sieve.

[9] The method of any one of [1] to [8] wherein the feeder includes a piston vibrator for producing weak vibration.

[10] The method of [9] wherein the piston vibrator produces vibration at a frequency of 30 to 200 Hz and a vibromotive force of 30 to 300 N.

[11] An apparatus for preparing a rare earth sintered magnet precursor from a corresponding alloy powder, comprising a mold and a feeder, said mold comprising a die, an upper punch having a pressure surface, and a lower punch having a pressure surface, the pressure surface of one or both of the upper and lower punches being shaped non-planar, a cavity being defined between the die and the lower punch, said feeder comprising a shooter having a lower end port for passage of the alloy powder, the port being in alignment with the mold cavity, a main sieve provided at the lower end port of the shooter, the main sieve having a sieve surface of substantially the same non-planar shape as the pressure surface of the upper or lower punch, and means for applying weak vibration to the shooter, wherein the alloy powder is fed into the mold cavity through the shooter while weak vibration is applied to the shooter to assist the alloy powder to pass through the main sieve and fall into the cavity, and the upper and lower punches are forced relative to each other to apply a uniaxial pressure to the alloy powder in the cavity under a magnetic field to form a precursor.

Advantageous Effects of Invention

The method is effective for preparing a rare earth sintered magnet of unique shape, typically C or D shape and of quality in a consistent manner and in high yields while preventing the sintered body from warp or deformation and even from cracks or fissures. The method can accommodate a variety of product shapes and ensures efficient preparation of sintered magnets. It is of great worth in the industry.

Figure 4A:
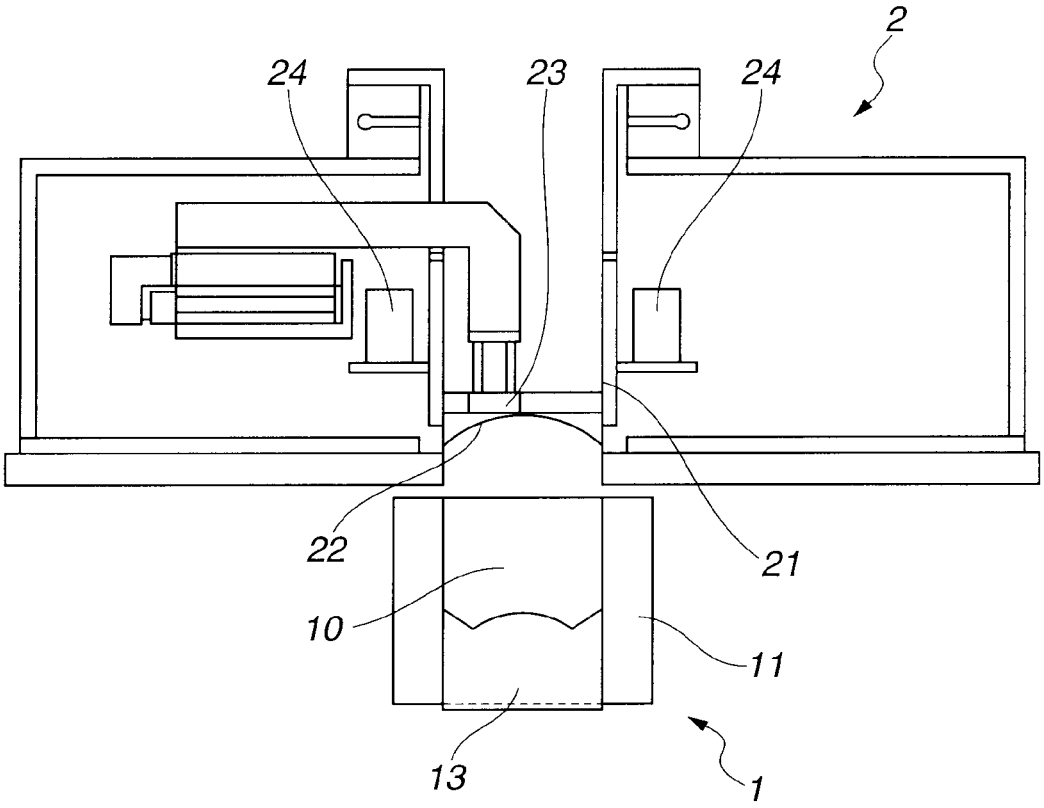
FIGS. 4 (A) and 4 (B) schematically illustrate one exemplary feeder and apparatus used in the magnet preparing method of the invention, FIG. 4 (A) being a vertical cross-sectional view and FIG. 4 (B) being a plan view.
Figure 4B:
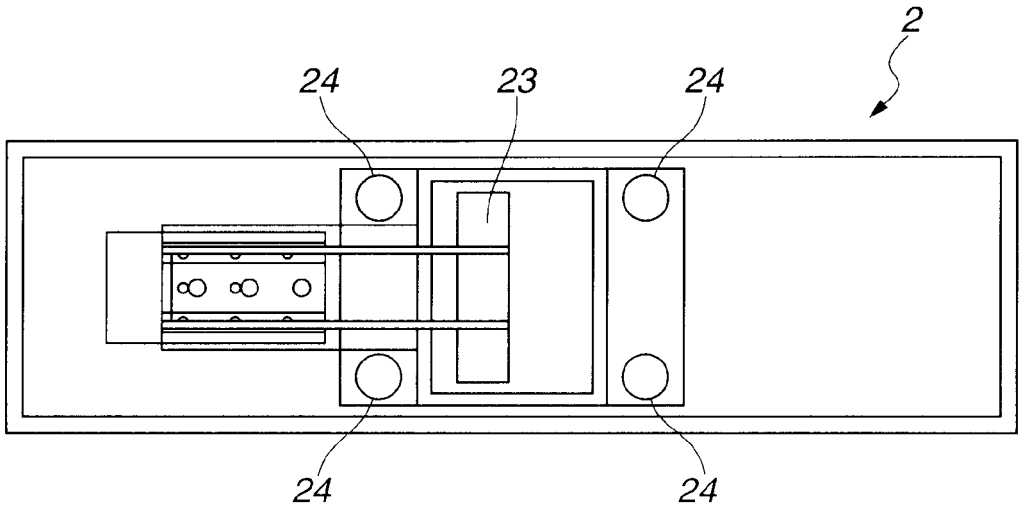

It is noted that the terms "upper", "lower" and analogues are often used with reference to the vertical cross-sectional view of FIG. 4 (A) since particles pass through the sieve and fall into the cavity under gravity.

DESCRIPTION OF PREFERRED EMBODIMENTS

Figure 1:
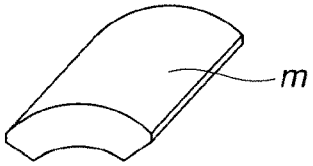
FIG. 1 is a perspective view of one exemplary magnet of C shape.
Figure 2A:
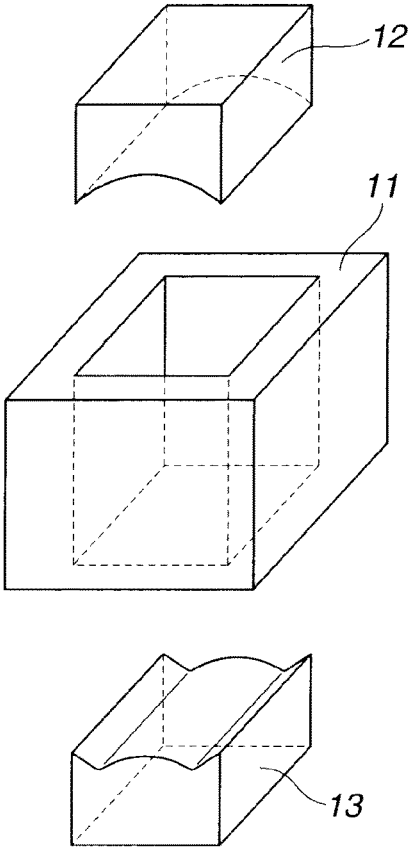
FIGS. 2 (A) and 2 (B) illustrate one exemplary mold used in the magnet preparing method of the invention, FIG. 2 (A) being perspective views, and FIG. 2 (B) being vertical cross-sectional views.
Figure 2B:
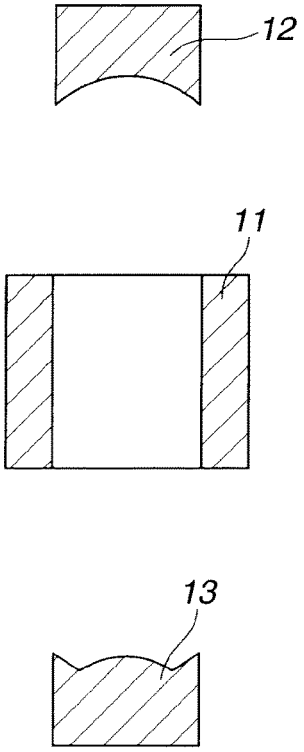

By the method of the invention, a rare earth sintered magnet is prepared by feeding a rare earth magnet-forming alloy powder into a mold cavity until the cavity is filled with the alloy powder, and compressing the alloy powder under a magnetic field. The method is best suited for the preparation of magnets having a non-planar shaped surface, typically curved surface, that is, of unique shape, typically C or D shape. The method for preparing a rare earth sintered magnet relies on compression molding using a mold comprising a die, an upper punch having a pressure surface, and a lower punch having a pressure surface. The pressure surface of one or both of the upper and lower punches is shaped non-planar, depending on the unique shape of a magnet to be prepared such as C or D shape. Specifically, when a sintered magnet M of C shape as shown in FIG. 1 is prepared, a mold as shown in FIG. 2 may be used. The mold includes a die 11 having an inner wall corresponding to the side surfaces of C-shaped magnet M, an upper punch 12 having a (downward) pressure surface corresponding to the upper surface of magnet M, and a lower punch 13 having an (upward) pressure surface corresponding to the lower surface of magnet M. More specifically, the pressure surface of upper punch 12 consists of a curved surface of arcuate arch shape, and the pressure surface of lower punch 13 consists of a curved surface segment of arcuate arch shape and two flanks extending from the opposite edges of the curved surface segment and inclined toward the convex side of the arch.

The non-planar shapes of upper and lower punches are not limited to the shapes of upper and lower punches 12 and 13 in FIG. 2. For example, it is acceptable that either one of the upper and lower punches has a pressure surface of non-planar shape and the other punch has a pressure surface of planar shape. The non-planar shape is preferably such that at least a portion (i.e., a portion or entirety) of the pressure surface is a curved surface. The curved surface may be of dome shape, inverse dome shape, arch shape including arcuate arch, or inverse arch shape including arcuate inverse arch. In particular, it is preferred that at least a portion of the pressure surface of one or both of the upper and lower punches be a curved surface of arch or inverse arch shape.

The non-planar shape may also be such that a portion of the pressure surface is a curved surface of dome, inverse dome, arch or inverse arch shape while the remainder is a curved surface of different shape or a planar surface. Exemplary are a shape consisting of a curved surface segment of dome or inverse dome shape and an outer circumferential segment extending outward from the periphery of the curved surface segment, and a shape consisting of a curved surface segment of arch shape (e.g., arcuate arch shape) or inverse arch shape (e.g., arcuate inverse arch shape) and two flank segments extending outward from the opposite edges of the curved surface segment. The outer circumferential segment or flank segments may be either curved or planar. The extending outer circumferential segment or flank segments may be inclined toward the convex side of dome, inverse dome, arch or inverse arch shape, or inclined opposite to the convex side, or horizontal.

The invention may be applied to the preparation of either Nd-based or Sm-based rare earth sintered magnets. When the invention is applied to Nd-based rare earth sintered magnets, exemplary is an alloy composition consisting of 20 to 35% by weight of R which is at least one rare earth element selected from Nd, Pr, Dy, Tb and Ho, up to 15% by weight of Co, 0.2 to 8% by weight of B, up to 8% by weight of at least one additive element selected from Ni, Nb, Al, Ti, Zr, Cr, V, Mn, Mo, Si, Sn, Ga, Cu and Zn, and the balance of Fe, and incidental impurities. A rare earth sintered magnet-forming alloy powder preferably has an average particle size of 1 to 10 μm after fine milling on a jet mill or the like. The average particle size may be determined, for example, by the laser light diffraction method as a median diameter.

The invention uses the mold having a cavity defined between the die and the lower punch, in cooperation with a feeder including a shooter. The rare earth sintered magnet-forming alloy powder is fed from the feeder into the mold cavity through the shooter until the cavity is filled with the alloy powder. The shooter has a lower end port for passage of the alloy powder, which is disposed in alignment with the mold cavity. The shooter is provided at the lower end port with a main sieve, which has a sifting surface of non-planar shape, preferably substantially the same non-planar shape as the pressure surface of the upper or lower punch, whereby the alloy powder passes through the main sieve and falls into the cavity.

Figure 3:
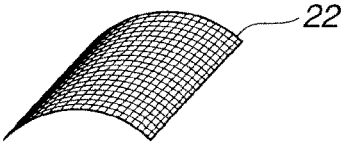
FIG. 3 is a perspective view of one exemplary sieve used in the magnet preparing method of the invention.

For example, when a sintered magnet of C shape as shown in FIG. 1 is prepared using a mold as shown in FIG. 2, a sieve 22 as shown in FIG. 3 may be used. The sieve 22 in FIG. 3 has a sifting surface of shape corresponding to the pressure surface of upper punch 12 in FIG. 2, that is, a curved surface of arcuate arch shape. Although FIG. 3 shows the sieve having a sifting surface of shape corresponding to the pressure surface of upper punch 12, a sieve having a sifting surface of shape corresponding to the pressure surface of lower punch 13 in FIG. 2 may also be used. Also the shape of the sifting surface of a sieve (not only the main sieve, but also an auxiliary sieve to be described later) is not limited to these examples, and the sieve used herein may have a sifting surface of another non-planar shape as exemplified above for the pressure surface of the upper and lower punches.

If the opening of the main sieve is less than 10 mesh, it may be difficult to retain the fine powder in the shooter of the feeder and hence, to fill the cavity with a metered amount of powder. If the opening of the main sieve exceeds 22 mesh, no problems arise with respect to the retaining of powder in the shooter and the metered filling of the cavity with powder, but it may take a long time to feed the powder until the necessary fill amount, and the method may become inefficient. It is thus preferred for consistent and efficient filling that the main sieve have an opening of 10 to 22 mesh (1.70 to 0.71 mm), more preferably 12 to 16 mesh (1.40 to 1.00 mm).

When the cavity defined between the die and the lower punch of the mold is filled with the rare earth sintered magnet-forming alloy powder, a feeder 2 of an apparatus as shown in FIG. 4 may be used, for example. The feeder 2 includes a shooter 21 having a lower end port for passage of the alloy powder, the port being disposed in alignment with the mold cavity. The shooter 21 is provided across its lower end port with the main sieve 22 in FIG. 3. The sieve 22 provided across the lower end port of shooter 21 is disposed closely above the cavity such that the sifting surface is at a position which is to be opposed to the pressure surface of the upper or lower punch having substantially the same shape during the subsequent compression step. Therefore the port is in alignment with the mold cavity. In the arrangement of mold 1 and feeder 2 and an apparatus shown in FIG. 4, the upper punch 12 shown in FIG. 2 is used, and the sifting surface of sieve 22 is of substantially the same shape as the pressure surface of upper punch 12. In the subsequent compression molding step, the upper punch 12 is placed on top of the alloy powder fill in the cavity 10 and forced toward the lower punch 13 to perform compression molding. In FIG. 4, the sifting surface of sieve 22 is disposed at the position that the pressure surface of the upper punch 12 will take during the subsequent compression step.

After the shooter 21 of feeder 2 and the mold 1 are arranged in alignment as shown in FIG. 4, the rare earth sintered magnet-forming alloy powder is fed from the feeder 2 through the shooter 21 and passed through the sieve 22. Then the alloy powder falls into the mold cavity 10 until the cavity 10 is filled with the alloy powder to a full extent. When the alloy powder is fed through the shooter 21 to the sieve 22, the alloy powder is normally retained on the sieve 22 and does not fall down under stationary conditions. To assist the alloy powder to pass through the sieve and fall down into the mold cavity, a vibrator and an optional powder distributor are used. Since a provision is made for forcing the alloy powder to pass through the sieve 22 and fall down into the mold cavity 10, the alloy powder fill in the cavity 10 is given an upper surface conforming to the shape of the sieve 22. In FIG. 4, the upper surface of the alloy powder fill (not shown) becomes a curved surface of arcuate arch shape.

The shooter may be provided with one or more auxiliary sieves above the main sieve. The auxiliary sieve may have a sifting surface of non-planar or planar shape, but preferably a sifting surface of substantially the same non-planar shape as the sifting surface of the main sieve. Preferably, one, two or three auxiliary sieves are used in order that the fill amount of alloy powder in the mold cavity per height of a magnet product to be molded be uniform among horizontally spaced apart positions so that the compact (precursor) for the sintered magnet may have a density with a minimized variation. Preferably the auxiliary sieve has an opening of 4 to 16 mesh (4.75 to 1.00 mm), more preferably 7.5 to 14 mesh (2.36 to 1.18 mm).

In addition, the main and auxiliary sieves are more effective when the sieves are arranged such that their opening becomes coarser toward the top. When the main sieve and two auxiliary sieves are used, for example, the main sieve having an opening of 14 mesh (1.18 mm), an intermediate auxiliary sieve having an opening of 12 mesh (1.40 mm), and a top auxiliary sieve having an opening of 10 mesh (1.70 mm) are arranged in order from the bottom to the top.

According to the invention, during the step of feeding the alloy powder into the cavity through the shooter, weak vibration is applied to the shooter to assist the alloy powder (remaining in the shooter and on the sieve) to pass through the main sieve and fall into the cavity. In FIG. 4, the feeder 2 further includes means for applying weak vibration to the shooter 21, specifically piston vibrators 24.

At least one weak vibrating means, preferably piston vibrator is disposed outside the shooter. If the frequency is less than 30 Hz, the weak vibrating means, typically piston vibrator may fail to produce stable vibration and hence, to provide for consistent supply of the alloy powder into the cavity. On the other hand, the weak vibrating means, typically piston vibrator capable of producing vibration at a frequency in excess of 200 Hz is not readily available. Therefore the weak vibrating means, typically piston vibrator capable of producing vibration at a frequency of 30 to 200 Hz is preferred, with a frequency of 50 to 150 Hz being more preferred.

If the vibromotive force of the weak vibrating means, typically piston vibrator is less than 30 N, no problems arise with respect to the quantitative and uniform supply of the alloy powder into the cavity, but it may take a long time to feed the alloy powder until the necessary fill amount, indicating inefficiency. If the vibromotive force exceeds 300 N, part of the alloy powder may be scattered out of the shooter, and the vibrator becomes of large size. Preferably the weak vibrating means, typically piston vibrator has a vibromotive force of 30 to 300 N, more preferably 50 to 200 N.

To fill the mold cavity uniformly with the alloy powder remaining in the shooter, a powder distributing means is preferably disposed above the main sieve for assisting the alloy powder to pass through the overall area of the main sieve and to fall down. Specifically, the feeder 2 includes a powder distributor 23 disposed within the shooter 21 and above the main sieve 22. The powder distributor 23 includes support members coupled to a drive and a plate attached to the support members. When the drive coupled to the support members is operated, the plate is horizontally moved back and forth to smooth or level the alloy powder on the sieve 22 while the alloy powder passes and falls through the sieve 22. The powder distributing means is not limited to the illustrated example. For example, a means for uniformly distributing the alloy powder on the sieve by placing 10 to 30 balls with a diameter of 10 to 20 mm on the sieve, and applying weak vibration to the balls and letting the balls impinge the sieve for thereby directly vibrating the sieve is also effective. The powder distributing means ensures more consistent supply of the alloy powder into the cavity and more uniform filling of the cavity with the powder.

Once the mold cavity is filled with the alloy powder, the upper punch is placed on top of the alloy powder fill, the upper and lower punches are forced relative to each other to apply a uniaxial pressure to the alloy powder in the cavity in a magnetic field to form a compact (precursor). For example, a magnetic field of 1.0 to 2.5 Tesla (T) and a pressure of 20 to 200 MPa may be applied to the alloy powder in the cavity. The compact is then heat treated into a sintered rare earth magnet. Specifically, the compact is sintered in a heat treatment furnace in high vacuum or a non-oxidizing gas atmosphere such as argon at a temperature of 1,000 to 1,200° C. for 1 to 10 hours. The sintering may be followed by further heat treatment (aging treatment) in vacuum or a non-oxidizing gas atmosphere such as argon at a lower temperature than the sintering temperature, preferably 400 to 700° C.

EXAMPLE

Examples are given below for further illustrating the invention although the invention is not limited thereto.

Example 1

A neodymium-based magnet alloy consisting of 30.0 wt % Nd, 1.0 wt % Dy, 1.0 wt % Co, 1.0 wt % B, 0.2 wt % Al, 0.2 wt % Cu, and the balance of Fe was coarsely crushed by hydrogen decrepitation and finely milled on a jet mill, obtaining a fine powder having an average particle size of 4.0 μm.

The fine powder was introduced in the shooter of the feeder shown in FIG. 4 and fed through a sieve of the shape of FIG. 3 with an opening of 10 mesh into a cavity defined by the die and the lower punch of the mold (size of the cavity: 40 mm width×70 mm height×50 mm length) configured as shown in FIG. 2. The piston vibrators having a frequency of 120 Hz and a vibromotive force of 100 N were operated to apply vibration to the shooter and sieve. The mold cavity was filled with the alloy powder to its full extent. The upper surface of the alloy powder fill was a curved surface of arcuate arch shape corresponding to the shape of the sieve. Then the upper punch was placed on top of the alloy powder fill. In a magnetic field, the powder was compression molded under a pressure of 100 MPa. In this way, there were obtained ten compacts of the shape shown in FIG. 1.

Figure 5A:
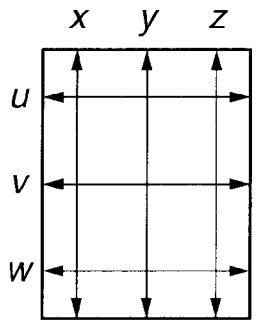
FIGS. 5 (A), 5 (B) and 5 (C) illustrate positions at which dimensions of a sintered magnet are measured in Examples and Comparative Examples, FIG. 5 (A) being a plan view, FIG. 5 (B) being a front view, and FIG. 5 (C) being a side view.
Figure 5B:
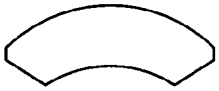
Figure 5C:
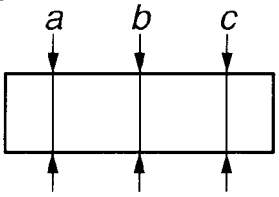

The compacts were placed in a heat treatment furnace where they were sintered in vacuum at 1,060° C. for 3 hours, followed by heat treatment in vacuum at 500° C. for 3 hours. In this way, there were obtained 10 sintered magnets. Each magnet was measured at a plurality of positions as shown in FIG. 5 for dimensions, with their average and standard deviation (S.D.) computed, and inspected for crack or fissure. The results are shown in Table 1. In FIG. 5, u, v and w are positions for measurement of width, a, b and c are positions for measurement of height, and x, y and z are positions for measurement of length, indicating that each dimension is measured at three points including the center and lateral positions. The result of crack/fissure is reported as a number of cracked or fissured samples per 10 samples.

Comparative Example 1

By the same procedure as in Example 1 except that a sieve having a planar sifting surface was used, the alloy powder was fed into the mold cavity. The upper surface of the alloy powder fill was a flat surface corresponding to the shape of the sieve. Subsequently, the same procedure as in Example 1 was followed until 10 sintered magnets were obtained. The sintered magnets were evaluated as in Example 1, with the results shown in Table 1.

TABLE 1

| | Dimension (mm) | | | | | | | | | Crack/ |
|---|---|---|---|---|---|---|---|---|---|---|
| | u | v | w | a | b | c | x | y | z | fissure |
| Example 1 | 40.01 | 40.09 | 39.99 | 21.10 | 21.02 | 21.11 | 50.04 | 49.88 | 50.08 | nil |
| | 40.07 | 40.18 | 40.05 | 21.08 | 21.00 | 21.07 | 50.00 | 49.92 | 50.05 | nil |
| | 39.99 | 40.05 | 40.00 | 21.05 | 20.98 | 21.07 | 50.10 | 49.95 | 50.08 | nil |
| | 40.02 | 40.07 | 40.01 | 21.02 | 20.94 | 21.05 | 50.06 | 49.85 | 50.11 | nil |
| | 40.02 | 40.09 | 40.00 | 20.98 | 20.92 | 21.04 | 50.01 | 49.92 | 50.05 | nil |
| | 40.05 | 40.11 | 40.04 | 20.99 | 20.91 | 21.02 | 49.98 | 49.83 | 50.01 | nil |
| | 39.97 | 40.08 | 40.01 | 21.12 | 21.05 | 21.14 | 49.93 | 49.77 | 50.00 | nil |
| | 40.08 | 40.13 | 40.04 | 21.15 | 21.10 | 21.18 | 50.13 | 50.00 | 50.14 | nil |
| | 40.00 | 40.06 | 39.95 | 21.04 | 21.00 | 21.06 | 50.17 | 50.01 | 50.11 | nil |
| | 39.95 | 40.04 | 39.98 | 21.06 | 21.01 | 21.08 | 50.11 | 49.96 | 50.09 | nil |
| Average | 40.02 | 40.09 | 40.01 | 21.06 | 20.99 | 21.08 | 50.05 | 49.91 | 50.07 | 0/10 |
| | S.D. 0.053 | | | S.D. 0.065 | | | S.D. 0.098 | | | |
| Comparative Example 1 | 39.85 | 40.01 | 39.82 | 21.02 | 20.97 | 21.01 | 49.92 | 49.77 | 50.24 | nil |
| | 40.07 | 40.15 | 39.91 | 21.11 | 21.05 | 21.09 | 49.85 | 49.71 | 50.09 | found |
| | 40.02 | 40.10 | 39.95 | 20.98 | 20.92 | 20.94 | 50.05 | 49.82 | 50.18 | nil |
| | 39.98 | 40.08 | 39.89 | 21.08 | 21.01 | 21.04 | 49.98 | 49.83 | 50.11 | nil |
| | 40.03 | 40.11 | 39.95 | 21.15 | 21.07 | 21.14 | 50.01 | 49.80 | 50.20 | nil |
| | 40.15 | 40.23 | 39.94 | 21.01 | 20.92 | 20.94 | 49.88 | 49.69 | 50.09 | found |
| | 39.88 | 40.12 | 39.77 | 20.95 | 20.90 | 20.95 | 49.98 | 49.71 | 50.15 | found |
| | 39.92 | 40.05 | 39.80 | 20.98 | 20.94 | 20.95 | 50.07 | 49.88 | 50.24 | nil |
| | 40.01 | 40.13 | 39.91 | 21.09 | 21.02 | 21.09 | 49.99 | 49.78 | 50.17 | nil |
| | 39.98 | 40.10 | 39.84 | 21.04 | 20.99 | 21.00 | 50.12 | 49.90 | 50.33 | nil |
| Average | 39.99 | 40.11 | 39.88 | 21.04 | 20.98 | 21.02 | 49.99 | 49.79 | 50.18 | 3/10 |
| | S.D. 0.118 | | | S.D. 0.068 | | | S.D. 0.179 | | | |

Examples 2 to 4

By the same procedure as in Example 1 except that a sieve having an opening of 6.5 mesh (Example 2), 12 mesh (Example 3) or 30 mesh (Example 4) was used, the alloy powder was fed into the mold cavity. Table 2 reports an average of the time taken until the mold cavity was filled with the alloy powder to the full extent. The upper surface of the alloy powder fill was a curved surface of arcuate arch shape corresponding to the shape of the sieve. Subsequently, the same procedure as in Example 1 was followed until 10 sintered magnets were obtained. Each of 10 sintered magnets was measured at a plurality of positions as shown in FIG. 5 for dimensions, with their average and standard deviation (S.D.) computed, and inspected for crack or fissure. The results are shown in Table 2.

TABLE 2

| | Filling time | Average dimension (mm) | | | | | | | | | Crack/ |
|---|---|---|---|---|---|---|---|---|---|---|---|
| | (s) | u | v | w | a | b | c | x | y | z | fissure |
| Example 2 | 18 | 39.99 | 40.08 | 39.83 | 21.03 | 20.97 | 21.01 | 49.99 | 49.78 | 50.15 | 0/10 |
| | | S.D. 0.108 | | | S.D. 0.066 | | | S.D. 0.153 | | | |
| Example 3 | 23 | 40.03 | 40.1 | 40.02 | 21.04 | 20.98 | 21.07 | 50.05 | 49.91 | 50.07 | 0/10 |
| | | S.D. 0.058 | | | S.D. 0.062 | | | S.D. 0.094 | | | |
| Example 4 | 120 | 40.01 | 40.11 | 40.05 | 21.03 | 20.98 | 21.05 | 50.06 | 49.95 | 50.08 | 0/10 |
| | | S.D. 0.055 | | | S.D. 0.062 | | | S.D. 0.096 | | | |

In Examples 1 to 4, neither crack nor fissure was found on the sintered bodies. As compared with the sintered bodies of Comparative Example 1, the sintered bodies of Examples 1 to 4 show less variations of dimension measurements, which indicate controlled warp or deformation. The sintered bodies of Comparative Example 1 contain several cracked or fissured samples and show noticeable variations of dimension measurements, which indicate serious warp or deformation. As is evident from these results, a uniform fill amount of fine powder per height of a magnet product in Examples ensures compression molding into a compact having a uniform density whereas a varying fill amount of fine powder per height of a magnet product in Comparative Examples leads to a compression molded compact having a varying density.

In particular, Example 3 using the sieve of 12 mesh is advantageous in that the time taken until the mold cavity is filled with the alloy powder is drastically shortened as compared with Example 4 using the sieve of 30 mesh; and the variation of dimension measurements is reduced as compared with Example 2 using the sieve of 6.5 mesh, and the development of cracks or fissures is avoided, indicating controlled warp or deformation.

Japanese Patent Application No. 2013-265244 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for preparing a rare earth sintered magnet from a corresponding alloy powder using a mold and a feeder, said mold comprising a die, an upper punch having a pressure surface, and a lower punch having a pressure surface, the pressure surface of one or both of the upper and lower punches being shaped non-planar, a cavity being defined between the die and the lower punch, the feeder including a shooter having a lower end port for passage of the alloy powder, the port being aligned with the cavity, said method comprising the steps of feeding the alloy powder from the feeder into the cavity through the shooter until the cavity is filled with the alloy powder, compressing the alloy powder fill in the cavity under a magnetic field between the upper and lower punches for uniaxial pressure molding to form a precursor, and heat treating the precursor, wherein the shooter is provided with a main sieve at its lower end port such that the main sieve is disposed closely above the cavity, the main sieve having a sifting surface of non-planar shape as the pressure surface of the upper or lower punch, during the step of feeding the alloy powder into the cavity through the shooter, vibration is applied to the shooter to assist the alloy powder to pass through the main sieve and fall into the cavity.

2. The method of claim 1 wherein the main sieve has an opening of 10 to 22 mesh.

3. The method of claim 1 wherein at least a portion of the pressure surface of one or both of the upper and lower punches is a curved surface of arch or inverse arch shape.

4. The method of claim 1 wherein the pressure surface of the upper punch is a curved surface of arcuate arch shape, and the pressure surface of the lower punch consists of a curved surface segment of arcuate arch shape and two flanks extending from the opposite edges of the curved surface segment and inclined toward the convex side of the arch.

5. The method of claim 1 wherein the shooter is provided with at least one auxiliary sieve in its interior above the main sieve.

6. The method of claim 5 wherein the auxiliary sieve has a sifting surface of non-planar shape as the sifting surface of the main sieve.

7. The method of claim 5 wherein the main and auxiliary sieves are arranged such that their opening becomes coarser toward the top.

8. The method of claim 1 wherein the feeder includes a powder distributor disposed above the main sieve for distributing the alloy powder over the main sieve so that the alloy powder may fall throughout the main sieve.

9. The method of claim 1 wherein the feeder includes a piston vibrator for producing vibration.

10. The method of claim 9 wherein the piston vibrator produces vibration at a frequency of 30 to 200 Hz and a vibromotive force of 30 to 300 N.

11. An apparatus for preparing a rare earth sintered magnet precursor from a corresponding alloy powder, comprising a mold and a feeder, said mold comprising a die, an upper punch having a pressure surface, and a lower punch having a pressure surface, the pressure surface of one or both of the upper and lower punches being shaped non-planar, a cavity being defined between the die and the lower punch, said feeder comprising a shooter having a lower end port for passage of the alloy powder, the port being in alignment with the mold cavity, a main sieve provided at the lower end port of the shooter, the main sieve having a sieve surface of non-planar shape as the pressure surface of the upper or lower punch, and means for applying vibration to the shooter, wherein the alloy powder is fed into the mold cavity through the shooter while vibration is applied to the shooter to assist the alloy powder to pass through the main sieve and fall into the cavity, and the upper and lower punches are forced relative to each other to apply a uniaxial pressure to the alloy powder in the cavity under a magnetic field to form a precursor.

* * * * *